US009151568B2

(12) United States Patent
Bélanger

(10) Patent No.: US 9,151,568 B2
(45) Date of Patent: Oct. 6, 2015

(54) RIFLE SLING

(71) Applicant: Daniel Bélanger, Boucherville (CA)

(72) Inventor: Daniel Bélanger, Boucherville (CA)

( * ) Notice: Subject to any disclaimer, the term of this patent is extended or adjusted under 35 U.S.C. 154(b) by 41 days.

(21) Appl. No.: 14/185,921

(22) Filed: Feb. 21, 2014

(65) Prior Publication Data

US 2015/0241167 A1 Aug. 27, 2015

(51) Int. Cl.
*F41C 33/00* (2006.01)

(52) U.S. Cl.
CPC ..... *F41C 33/002* (2013.01)

(58) Field of Classification Search
CPC ..... F41C 33/00; F41C 33/002; F41C 33/005; F41C 33/007
See application file for complete search history.

(56) References Cited

U.S. PATENT DOCUMENTS

| | | | | | |
|---|---|---|---|---|---|
| 1,332,088 | A * | 2/1920 | Wagner | ..... | 224/150 |
| 1,383,125 | A * | 6/1921 | Kennedy, Jr. | ..... | 224/150 |
| 2,357,363 | A * | 9/1944 | Smith et al. | ..... | 224/150 |
| 2,446,197 | A * | 8/1948 | Sloan | ..... | 224/150 |
| 3,495,770 | A * | 2/1970 | Rolling et al. | ..... | 224/150 |
| 3,948,423 | A * | 4/1976 | Hathaway | ..... | 224/150 |
| 4,249,686 | A * | 2/1981 | Morwood | ..... | 224/150 |
| 4,511,070 | A * | 4/1985 | Hightower | ..... | 224/150 |
| 4,768,689 | A * | 9/1988 | Davis | ..... | 224/257 |
| 5,143,266 | A * | 9/1992 | Heckerman et al. | ..... | 224/150 |
| 5,802,756 | A * | 9/1998 | Hightower | ..... | 42/85 |
| 2007/0257072 | A1 * | 11/2007 | Pena et al. | ..... | 224/150 |

* cited by examiner

*Primary Examiner* — Brian D Nash

(57) ABSTRACT

An improved rifle sling comprising of three buckles on an adjustable belt. An adjustment buckle having two serrated openings, a hooked buckle having two serrated openings and a hook at one end and a sliding buckle angled or bent at the middle with two smooth openings. The adjustment buckle allows the user to adjust the belt to a desired length. The sliding buckle is attached to one end of the belt and slides about the rest of the belt. The sliding buckle hooks onto the hooked buckle that is attached close to the other end of the belt when carrying the rifle close to the body. The sliding buckle is unhooked from hooked buckle adding slack to the belt as it slides across it allowing the rifle to be raised normally when it is to be deployed rapidly into a shooting position. The rifle can be carried across the back or front of a user's body.

8 Claims, 2 Drawing Sheets

FIG.1a
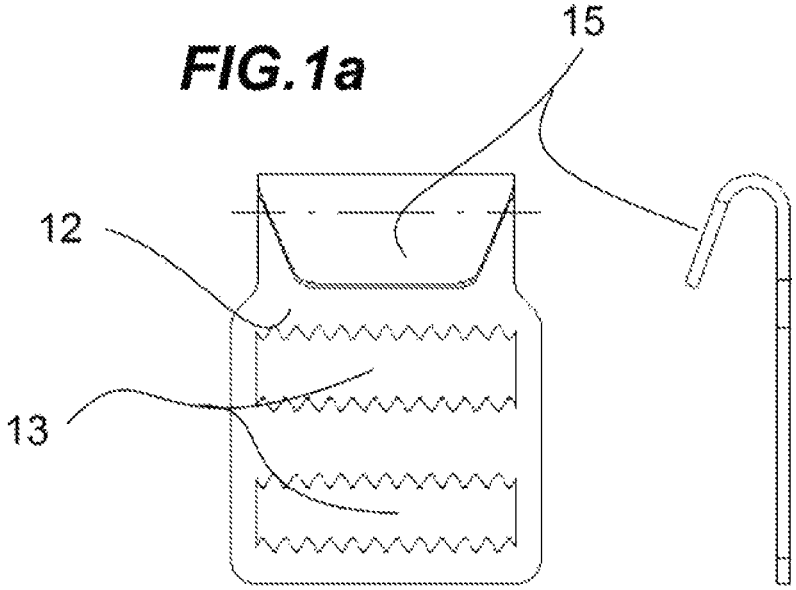
FIG.1b
FIG.1c
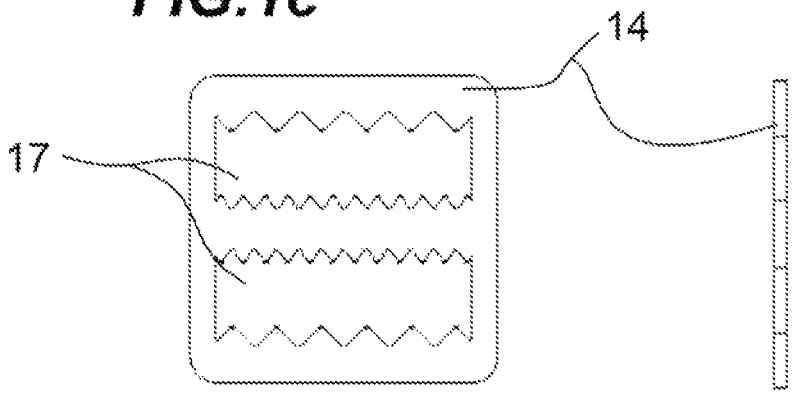
FIG. 1d
FIG. 1e
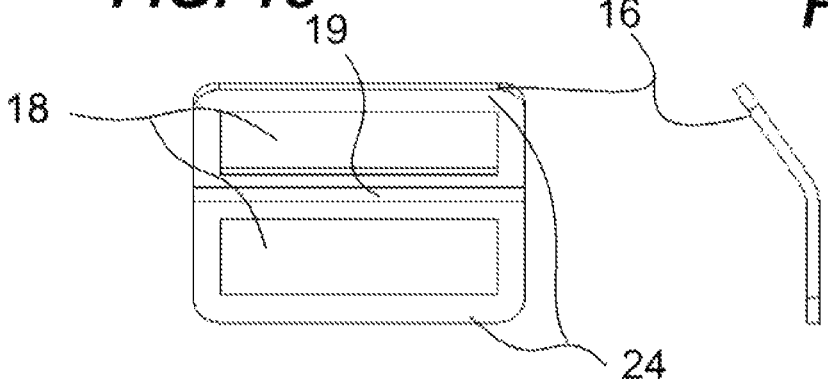
FIG. 1f

RIFLE SLING

FIELD OF THE INVENTION

The present invention relates generally to hunting equipment but more particularly to an improved hunting rifle sling that allows rapid execution from sling to firing position.

BACKGROUND OF THE INVENTION

Beginning as a necessity of life and a means of livelihood, hunting has evolved over the centuries into a sport and a method of maintaining balance in many countries. Hunters have for the last few hundred years relied on the rifle as a weapon of choice. The hunting rifle is traditionally slung over one shoulder or across the body with a one banded sling or supported on both shoulders in other versions which offers more stability. In both cases when a hunter comes upon his or her prey, often unexpectedly, the process of executing the rifle into a shooting position is restrictive and takes time. This increases the chance of the prey spotting or sensing the hunter and moving away. There hence exists a need for a method or sling that reduces the time taken to deploy the rifle into a shooting position.

SUMMARY OF THE INVENTION

In view of the foregoing disadvantages inherent in the known devices now present in the prior art, the present invention, which will be described subsequently in greater detail, is to provide objects and advantages which are:

To provide for an improved hunting sling that allows the rifle to move from sling position to aiming position in one swift movement.

It is a another advantage of this invention to support the rifle close to the body, freeing the hands, allowing ease of movement for the user.

It is a further advantage of this invention that it be worn either in front or at the back depending on the type of movement and user preference.

In order to do so, the invention has 3 buckles set upon a belt having two ends that attach to the hunting rifle. One buckle is an adjustment buckle that allows the belt to be lengthened or shortened to the user's desired length.

A second buckle with a hook at one end is affixed on the belt close to the attachment that fixes to the front of the rifle. The belt passes through it and the buckle remains fixed at the point it is attached. A third buckle angled at approximately 145 degrees has the other end of the belt looped around its central arm and one of its two openings runs about the main length of the belt such that it is able to slide from one end of the point of attachment to the rifle to the other.

The adjustment buckle has two openings with serrated edges and the hooked buckle also has two openings with serrated edges for the belt to fix firmly. The angled sliding buckle has two openings with smooth edges enabling it to slide across the belt with ease.

The rifle is slung over the back when the user needs to climb, descend or generally walk to and from his or her hunting spot. The sliding buckle is hooked over the hooked stationary buckle such that the belt is tight, keeping the rifle close to the user's body. Alternatively it can be slung across the front of the user, ready to deploy into shooting position by unhooking the sliding buckle from the hooked buckle thereby giving the belt enough of slack or run to deploy the rifle into shooting position, without having to physically remove the sling. The present invention can have the belt and buckles made out of a variety of materials and colors.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 1*a-f* Top and side views of a hooked buckle, an adjustment buckle, and a sliding buckle.

DETAILED DESCRIPTION OF THE PREFERRED EMBODIMENT

Figure 2A:
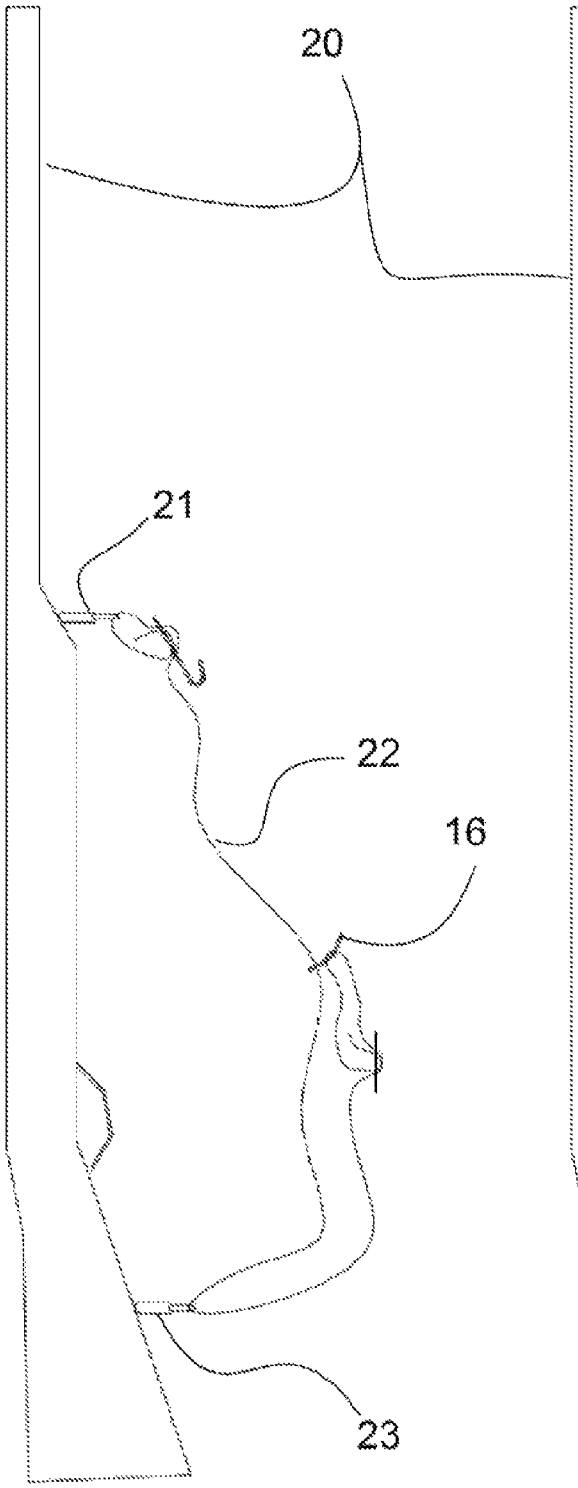
FIGS. 2*a-b* Side views of the invention in hooked and unhooked positions and affixed upon a rifle.

An improved rifle sling (10) comprising of a belt member (22) having a first and a second means of attachment (21, 23) to attach to a rifle (20), and each one of the attachment means (21, 23) having openings adapted to allow the belt member (22) to slidably pass therethrough for adjusting and connecting the rifle (20).

The rifle sling (10) comprises the belt member (22) affixed with a hooked buckle (12), an adjustment buckle (14) and a sliding buckle (16). The hooked buckle (12) has a hook (15) at one end and two serrated openings (13) through which the belt member (22) passes and it is positioned near one end of the belt (22), near the point of attachment (21) to the rifle (20).

The adjustment buckle (14) has two serrated openings (17) and is meant for a user (not shown) to adjust the belt (22) to a desired length. In other words, it adds some slack length to the belt and can be referred to as slack length. The sliding buckle (16) is angled such that one half of it is approximately 35 degrees above the horizontal or other half (see FIG. 1*c*). The sliding buckle (16) has two smooth openings (18) and one end of the belt (22) is looped around its central arm (19) while the main length of the belt (22) runs through one of its two smooth openings (18).

Figure 2B:
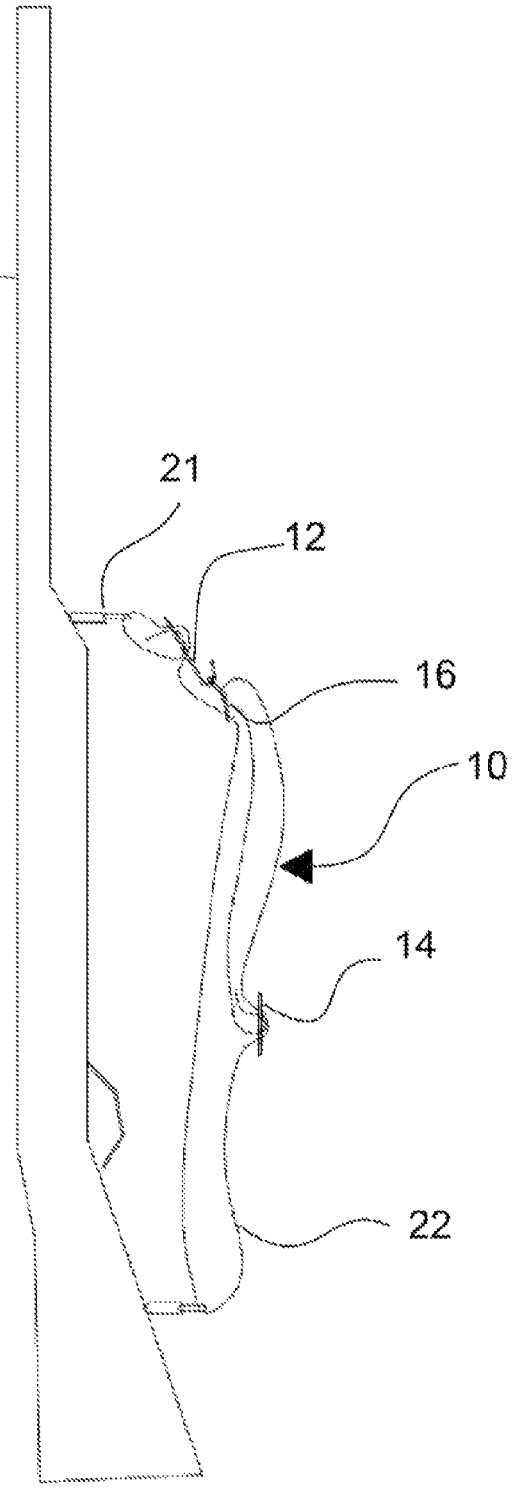

The rifle sling (10) when worn in front of the body (not shown) holds the rifle (20) close to the body (not shown) when one of the outer arms (24) of the sliding buckle (16) is hooked onto the hooked buckle (12) as in FIG. 2*b*. The sliding buckle (16) is removed from the hook (15) when the rifle (20) is to be deployed in a shooting position allowing instant slack in the belt (22) as seen in FIG. 2*a*, allowing the rifle (20) to be raised while maintaining the belt (22) around the user (not shown).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An improved rifle sling comprising:

a belt member having an end portion thereof adapted to be connected to a first attachment means portion of a rifle, an opposite end portion of said belt member adapted to be slidably attached to a second attachment means of said rifle portion of said belt member in between said end portion and said opposite end portion thereby forming a looped portion, and a middle portion adapted to be slidably attached to a second portion of said rifle spaced from said first portion;

a hooked buckle adjustably attached to said end portion of said belt member, said hooked buckle having a hook portion on an end thereof;

an adjustment buckle adjustably attached to said opposite end portion of said belt member and said portion of said belt member in between said end portion and said opposite end portion, thereby forming said looped portion and providing a means for adjusting the size of said looped portion; and a sliding buckle slidably attached to said belt member upon a portion of said looped portion, and including an attachment portion that is adapted to removably attach to said hook portion of said hooked buckle, such that when said attachment portion of said sliding buckle is attached to said hook portion of said hooked buckle, a slack length of the belt is such that said rifle is adapted to be held close to the body of a person carrying said rifle, and when said attachment portion of said sliding buckle is removed from said hook portion of said hooked buckle said sliding buckle slides along a length of said belt member thereby increasing said slack length, and thereby allowing said person to more easily and quickly deploy said rifle into a shooting position; said hooked buckle includes two serrated openings through which said belt is adapted to pass therethrough.

2. The improved rifle sling of claim 1, wherein said adjustment buckle includes two serrated openings through which said belt is adapted to pass therethrough.

3. The rifle sling of claim 1, wherein said sliding buckle is bent forming two portions that are angled with respect to one another at an angle of 35 degrees; wherein said sliding buckle includes two smooth openings forming a central arm therebetween, and wherein said belt member is adapted to be looped around said central arm and through said smooth openings.

4. A combination of a rifle and an improved rifle sling, said combination comprising:

a rifle including a stock portion, a barrel portion, and a trigger member connected to said stock member, a first means for attachment of a sling member located upon said stock portion in proximity to said barrel portion, and a second means for attachment of a sling member located on said stock portion at a location separated from said first means for attachment and on an opposite side of said trigger member therefrom; and an improved sling member comprising:

a belt member having an end portion thereof adapted to be connected to said first means for attachment, an opposite end portion adapted to be connected to said second means for attachment and slidably attached to a portion of said belt member in between said end portion and said opposite end portion thereby forming a looped portion, and a middle portion adapted to be slidably attached to a second portion of said rifle spaced from said first portion;

a hooked buckle adjustably attached to said end portion of said belt member, said hooked buckle having a hook portion on an end thereof;

an adjustment buckle adjustably attached to said opposite end portion of said belt member and said portion of said belt member in between said end portion and said opposite end portion, thereby forming said looped portion and providing a means for adjusting the size of said looped portion; and a sliding buckle slidably attached to said belt member upon a portion of said looped portion, and including an attachment portion that is adapted to removably attach to said hook portion of said hooked buckle, such that when said attachment portion of said sliding buckle is attached to said hook portion of said hooked buckle, a slack length of the belt is such that said rifle is adapted to be held close to the body of a person carrying said rifle, and when said attachment portion of said sliding buckle is removed from said hook portion of said hooked buckle said sliding buckle slides along a length of said belt member thereby increasing said slack length, and thereby allowing said person to more easily and quickly deploy said rifle into a shooting position; said hooked buckle includes two serrated openings through which said belt is adapted to pass therethrough.

5. The combination of claim 4, wherein said adjustment buckle includes two serrated openings through which said belt is adapted to pass therethrough.

6. The combination of claim 4, wherein said sliding buckle is bent forming two portions that are angled with respect to one another at an angle of 35 degrees; wherein said sliding buckle includes two smooth openings forming a central arm therebetween; and wherein said belt member is adapted to be looped around said central arm and through said smooth openings.

7. The combination of claim 4, wherein said first means for attachment has openings adapted to allow said belt member to slidably pass therethrough.

8. The combination of claim 4, wherein said second means for attachment has openings adapted to allow said belt member to slidably pass therethrough, such that when said attachment portion of said sliding buckle is being attached to said hook portion of said hooked buckle, a portion of said belt member passes through said openings and said slack length of said belt member is reduced, and when said attachment portion of said sliding buckle is removed from said hook portion of said hooked buckle said sliding buckle slides along a length of said belt member and said portion of said belt member passes through said openings in an opposite direction thereby increasing said slack length, and thereby allowing said person to more easily and quickly deploy said rifle into a shooting position.

* * * * *